US012628943B2

(12) United States Patent
Chen

(10) Patent No.: US 12,628,943 B2
(45) Date of Patent: May 19, 2026

(54) EASY-TO-TRANSPORT THREE-SPLICED TABLE

(71) Applicant: SOPHIA & WILLIAM BRANDS CO. LTD, Nanjing (CN)

(72) Inventor: Meidi Chen, Nanjing (CN)

( * ) Notice: Subject to any disclaimer, the term of this patent is extended or adjusted under 35 U.S.C. 154(b) by 70 days.

(21) Appl. No.: 18/740,766

(22) Filed: Jun. 12, 2024

(65) Prior Publication Data

US 2025/0380796 A1 Dec. 18, 2025

(51) Int. Cl.

*A47B 13/02* (2006.01)
*A47B 13/00* (2006.01)
*A47B 13/08* (2006.01)

(52) U.S. Cl.

CPC ..... *A47B 13/02* (2013.01); *A47B 13/003* (2013.01); *A47B 13/088* (2013.01); *A47B 2200/0012* (2013.01)

(58) Field of Classification Search

CPC ..... A47B 13/02; A47B 13/003; A47B 13/088; A47B 37/04

See application file for complete search history.

(56) References Cited

U.S. PATENT DOCUMENTS 8,418,633 B1 * 4/2013 Lee ..... A47B 13/003 108/157.15
2003/0010261 A1 * 1/2003 Liu ..... A47B 13/06 108/153.1
2004/0016376 A1 * 1/2004 Rivera ..... A47B 13/06 108/157.1
2011/0303124 A1 * 12/2011 Tseng ..... A47B 37/04 108/23
2012/0079967 A1 * 4/2012 Palese ..... A47B 1/08 108/71
2019/0125071 A1 * 5/2019 Heim ..... A47B 3/002
2019/0335892 A1 * 11/2019 Garrison ..... A47B 3/12
2021/0219771 A1 * 7/2021 Juve ..... A47J 31/469
2021/0307548 A1 * 10/2021 Raghoonandan ..... B60N 3/102
2022/0152473 A1 * 5/2022 Baker ..... A47B 37/00
2024/0000223 A1 * 1/2024 Yang ..... A47B 13/06
2024/0398108 A1 * 12/2024 Zhang ..... A47B 3/12
2025/0143450 A1 * 5/2025 Chen ..... A47B 37/04
2025/0176705 A1 * 6/2025 Chen ..... A47B 37/04
2025/0228356 A1 * 7/2025 Li ..... A47B 13/003

FOREIGN PATENT DOCUMENTS

CN 107912864 A 4/2018
CN 217524224 U 10/2022
CN 219762741 U 9/2023

* cited by examiner

*Primary Examiner* — Daniel J Rohrhoff
(74) *Attorney, Agent, or Firm* — Nitin Kaushik

(57) ABSTRACT

The present invention relates to the technical field of tableware, in particular, to an easy-to-transport three-spliced table. The three-spliced table includes table legs arranged at four corners of a table top, where the table legs and the table top are reinforced by a plurality of groups of reinforcing members; the table top is formed by splicing a first table plate, a second table plate and a third table plate side by side; and the table top of the three-spliced table is divided into three parts when being opened, which are not different from a table with a complete table top after being assembled through screws. During transportation, the packaging volume is reduced, the transportation cost is saved, and the risk of packaging damage and product damage during transportation is reduced.

14 Claims, 13 Drawing Sheets

EASY-TO-TRANSPORT THREE-SPLICED TABLE

TECHNICAL FIELD

The present invention relates to the technical field of tableware, in particular, to an easy-to-transport three-spliced table.

BACKGROUND

In order to better get close to nature and relax body and mind, more and more people take the time for outdoor leisure activities, and an outdoor leisure table comes into view of people. The outdoor leisure table is provided in many outdoor occasions, to facilitate people to take a rest.

At present, the outdoor leisure table on the market is large in size, a table top, table legs and a reinforcing member can be split from each other, but the table top is a single unit that cannot be split and is composed of a complete flat plate. A large-size table has a large table top size, and the package thereof is difficult to handle during transportation, the transportation cost is relatively high, a special transportation vehicle needs to be used for loading and transporting, and packaging is prone to being damaged.

Therefore, the present applicant provides an easy-to-transport three-spliced table, for solving the problems raised in the above background.

SUMMARY

The invention aims to provide an easy-to-transport three-spliced table, so as to solve the problems that an existing large-size table is too large in size and cannot be split, and is difficult to handle during transportation, the transportation cost is relatively high, a special transportation vehicle needs to be used for loading and transporting, and packaging is prone to being damaged.

In order to solve the above technical problem, the present invention provides an easy-to-transport three-spliced table, including table legs arranged at four corners of a table top, where the table legs and the table top are reinforced by a plurality of groups of reinforcing members; and the table top is formed by splicing a first table plate, a second table plate and a third table plate side by side.

Further, frames are both arranged around the first table plate, the second table plate and the third table plate, two cross beams are welded to an inner wall enclosed by the frames, the cross beams are arranged in parallel, a lower surface of each of the cross beams is coplanar with a lower surface of each of the frames, several vertical plates are distributed on an upper surface of each of the cross beams, and two ends of each of the vertical plates abut against the inner wall of the frames; and two side edges of the second table plate are fixedly connected to a side edge of the first table plate and a side edge of the third table plate respectively through bolt holes A.

Further, a group of threaded holes B are arranged at the bottoms of the cross beams of the first table plate and the third table plate respectively, and two groups of threaded holes B are arranged at the bottom of each of the cross beams of the second table plate.

Further, four transverse reinforcing long rods are arranged at the bottom of the table top, a group of threaded holes B are arranged at two ends of each of the reinforcing long rods respectively, and the reinforcing long rods are arranged at the bottoms of two adjacent cross beams of the first table plate and the second table plate, the second table plate and the third table plate through the bolts and the threaded holes B for reinforcing the table top.

Further, connecting members are fixed at four corners of the bottom of the table top, threaded holes C are arranged at a bottom surface of each of the connecting members and a top surface of each of the table legs respectively, and the top surface of each of the table legs is connected to the bottom surface of each of the connecting members through the bolts and the threaded holes C.

Further, the table legs are connected to a square reinforcing frame through connecting rods; and one end of the connecting rod is fixed in the middle of the table leg, threaded holes D are arranged on an end portion of the other end of the connecting rod and four corners of the square reinforcing frame respectively, and the end portion of the other end of the connecting rod is connected to the four corners of the square reinforcing frame through the bolts and the threaded holes D.

Further, the square reinforcing frame is formed by splicing two U-shaped reinforcing frames; and a reinforced connecting frame is mounted in an interior enclosed by the square reinforcing frame, L-shaped reinforcing rods are mounted on two side edges of an outer portion of the square reinforcing frame respectively, threaded holes E are arranged at two ends of the reinforced connecting frame, two side edges of the square reinforcing frame and a side wall where a long edge of the L-shaped reinforcing rod is located respectively, and the reinforced connecting frame, the square reinforcing frame, and the L-shaped reinforcing rod are connected through the bolts and the threaded holes E.

Further, threaded holes F are arranged at two side edges of a bottom surface of the table top and an end portion where a short edge of the L-shaped reinforcing rod is located respectively, and the bottom of the table top is connected to the L-shaped reinforcing rod through the bolts and the threaded holes F.

Further, a through hole is arranged in the middle of the second table plate in a penetrating manner, an umbrella hole plug is sleeved in the through hole, a reinforced connecting frame is arranged right below the umbrella hole plug, and a placing hole is arranged in the middle of the reinforced connecting frame in a penetrating manner and used for placing a sunshade umbrella handle.

Further, an anti-skid gasket is mounted at the bottom of each of the table legs.

The present invention has the following beneficial effects after adopting the above-mentioned technical solution:

1. According to an easy-to-transport three-spliced table provided by the present invention, a table top of the three-spliced table is divided into three parts when being opened. A first table plate, a second table plate and a third table plate are reinforced through four detachable reinforcing long rods, and reinforcing members at table legs can also be split. The above components, after being assembled through bolts, are not different from a table with a complete table top. During transportation, the packaging volume is reduced, the transportation cost is saved, and the risk of packaging damage and product damage during transportation is reduced.

2. According to the three-spliced table of the present invention, in order to ensure that the table is stable in structure after being assembled, reinforcing members are both used between the table plates, between the table top and the table legs, and between the table legs, so as to improve the overall stability of the three-spliced table.

BRIEF DESCRIPTION OF DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Reference signs: 1. table top; 101. first table plate; 102. second table plate; 103. third table plate; 111. frame; 112. cross beam; 113. vertical plate; 114. connecting member; 2. table leg; 201. connecting rod; 202. anti-skid gasket; 3. reinforcing member; 301. reinforcing long rod; 302. square reinforcing frame; 303. U-shaped reinforcing frame; 304. reinforced connecting frame; 3041. placing hole; 305. L-shaped reinforcing rod; 4. bolt hole A; 5. threaded hole B; 6. threaded hole C; 7. threaded hole D; 8. threaded hole E; 9. threaded hole F; 10. umbrella hole plug.

DETAILED DESCRIPTION OF THE EMBODIMENTS

An explicit and complete description of the technical solution in the present invention is given below in conjunction with the accompanying drawings. Apparently, the described embodiments are part not all of the embodiments of the present invention. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Figure 1:
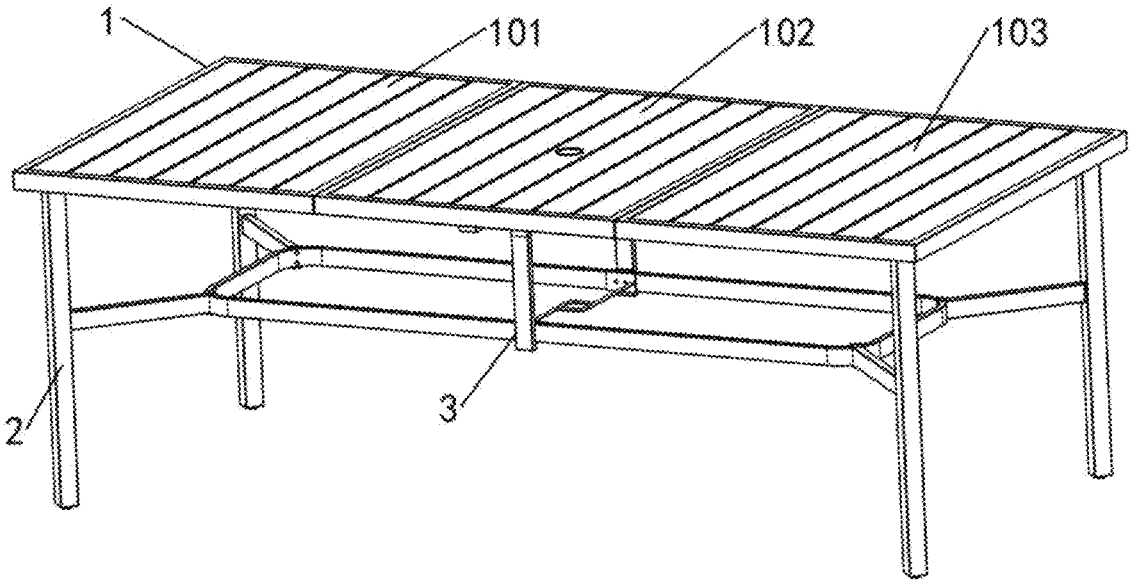
FIG. 1 is a schematic diagram of an overall structure of an easy-to-transport three-spliced table.
Figure 2:
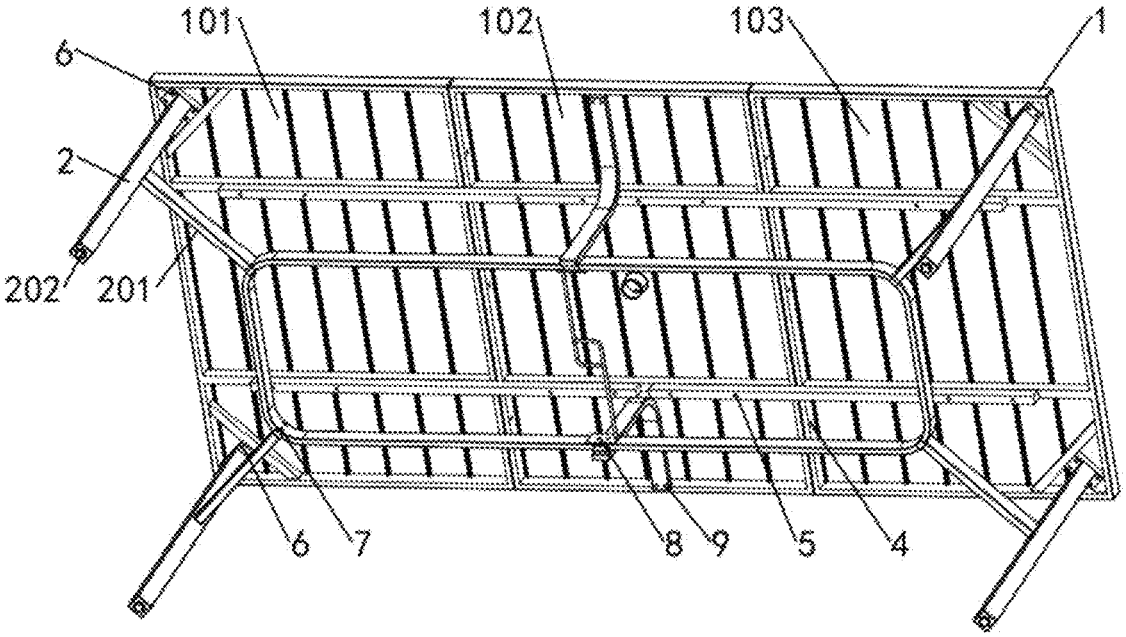
FIG. 2 is a schematic diagram of a bottom structure of an easy-to-transport three-spliced table.
Figure 3:
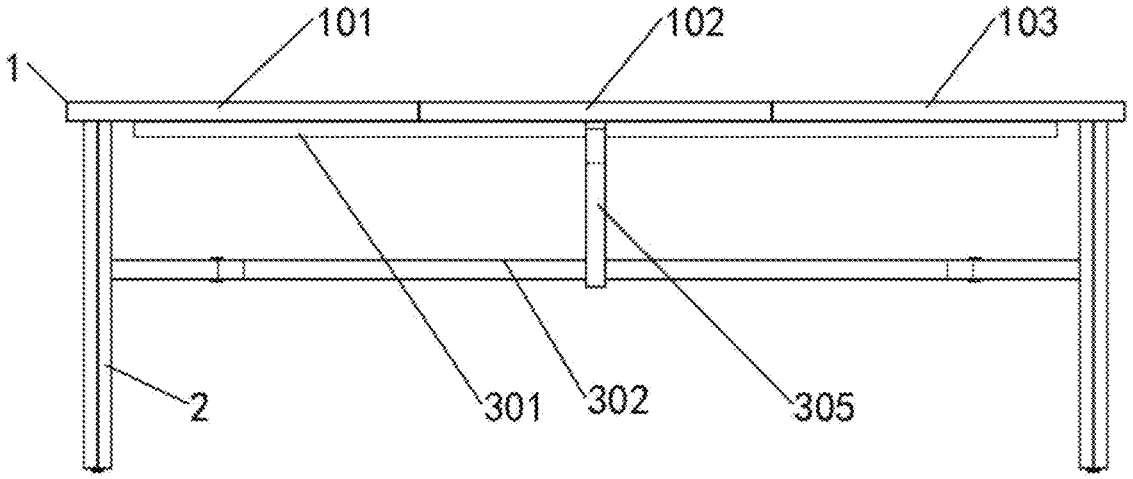
FIG. 3 is a front view of an easy-to-transport three-spliced table.
Figure 4:
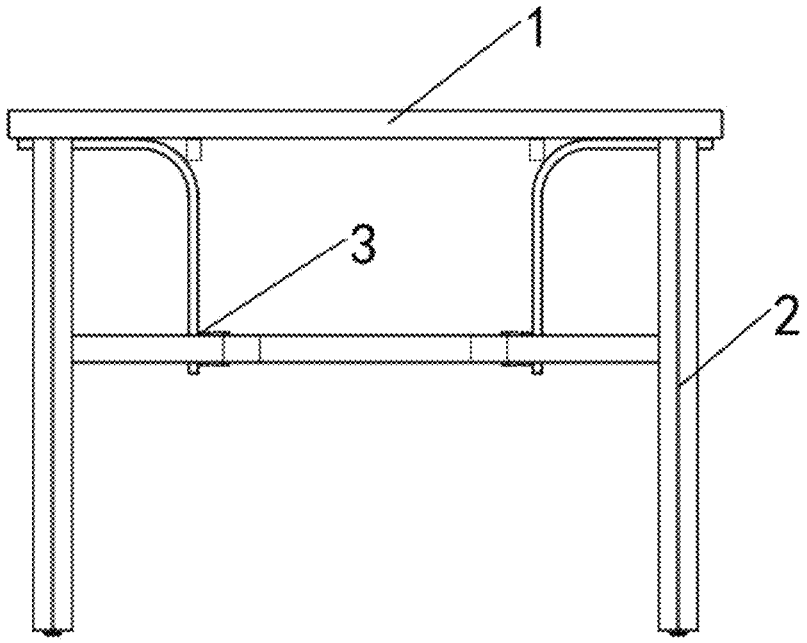
FIG. 4 is a side view of an easy-to-transport three-spliced table.
Figure 5:
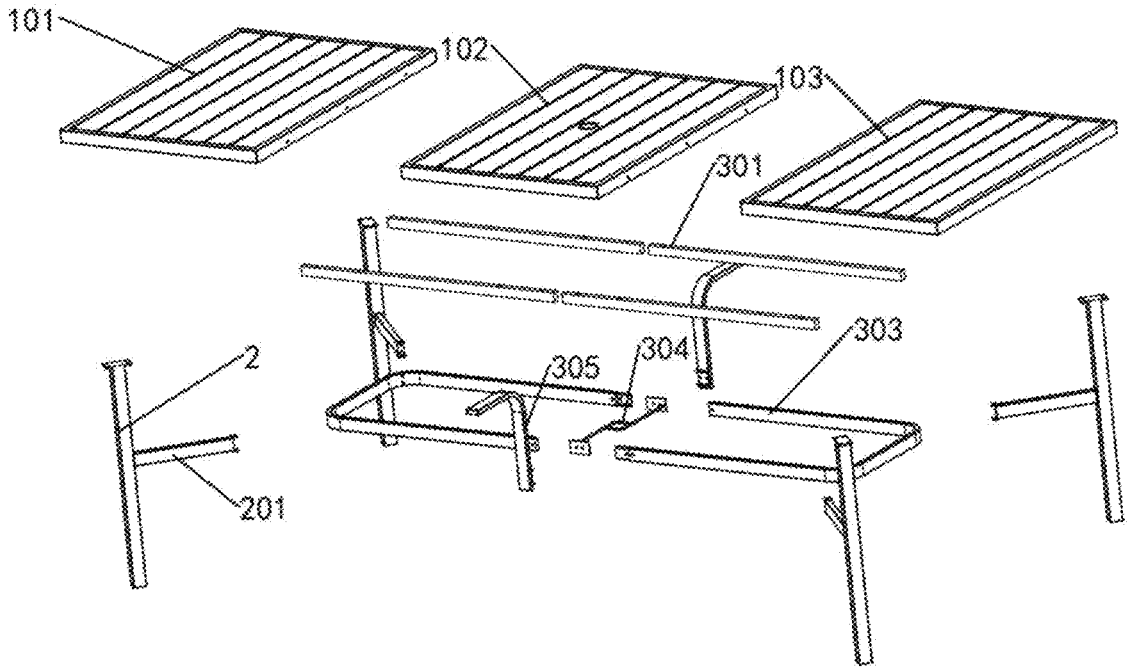
FIG. 5 is a schematic diagram of an explosion structure of an easy-to-transport three-spliced table.
Figure 6:
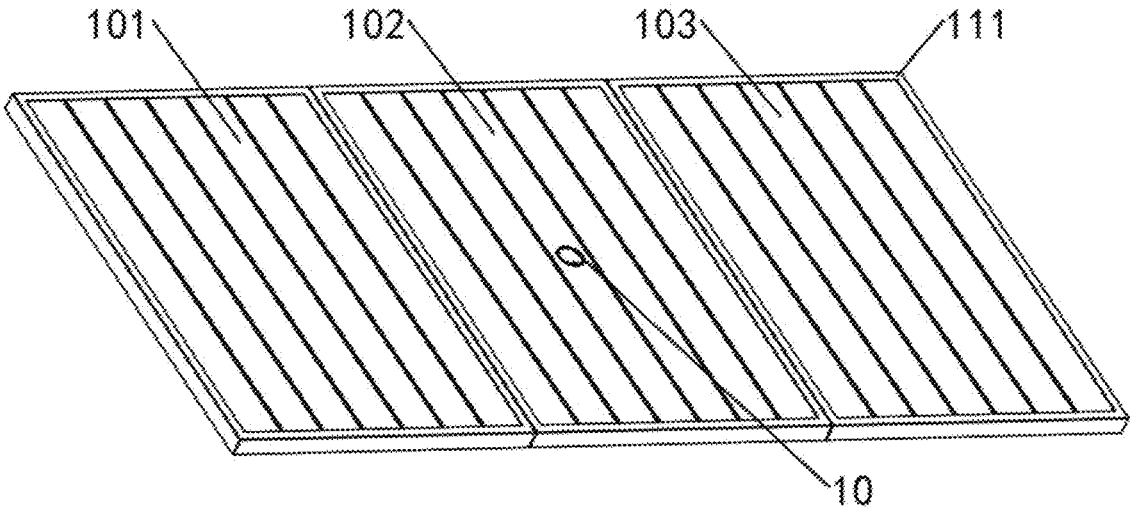
FIG. 6 is a schematic diagram of a left front structure of a table top in FIG. 1.
Figure 7:
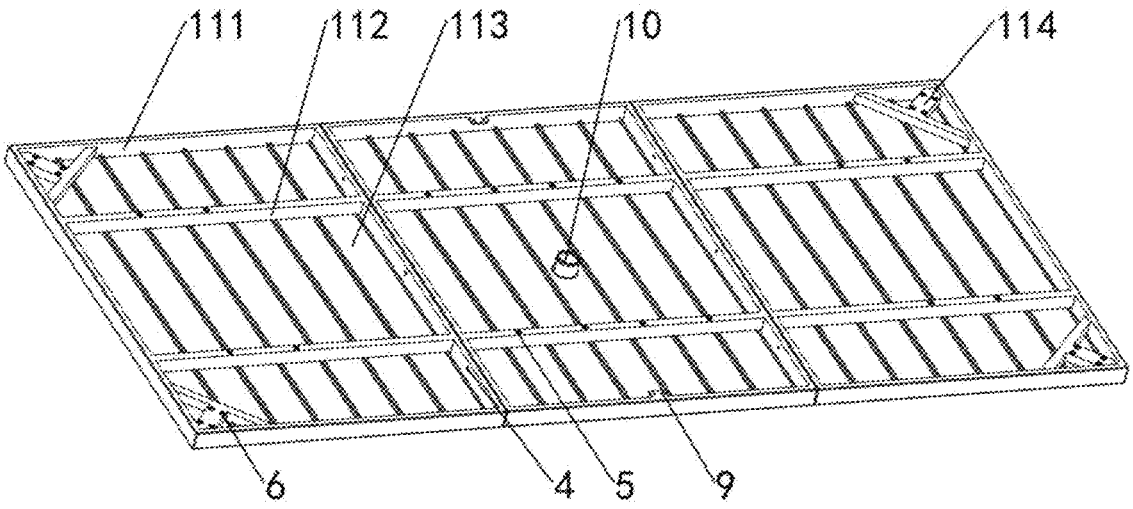
FIG. 7 is a schematic diagram of a bottom structure of a table top in FIG. 1.
Figure 8:
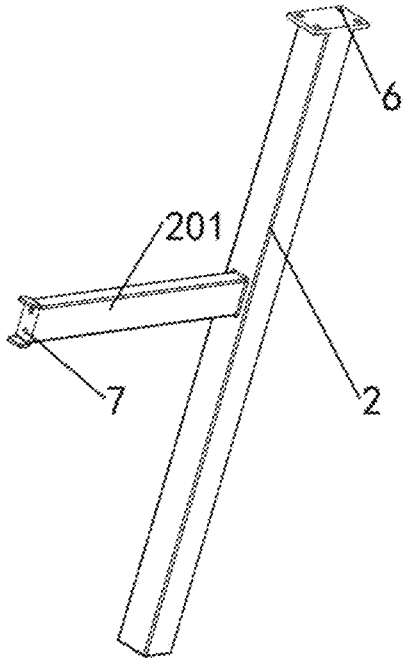
FIG. 8 is a schematic diagram of an overall structure of a table leg in FIG. 1.
Figure 9:
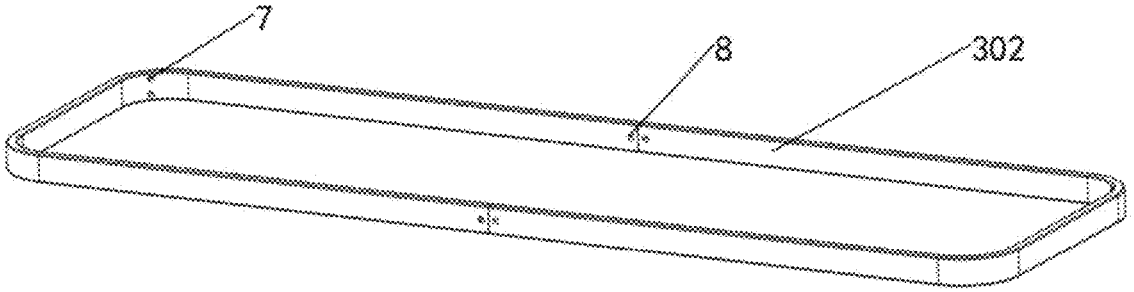
FIG. 9 is a schematic diagram of an overall structure of a square reinforcing frame in FIG. 1.
Figure 10:
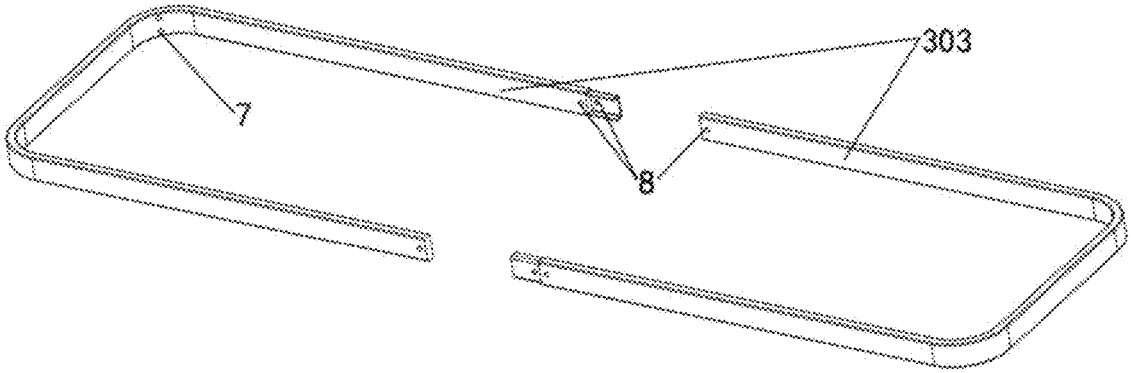
FIG. 10 is a schematic diagram of an overall structure of a U-shaped reinforcing frame in FIG. 9.
Figure 11:
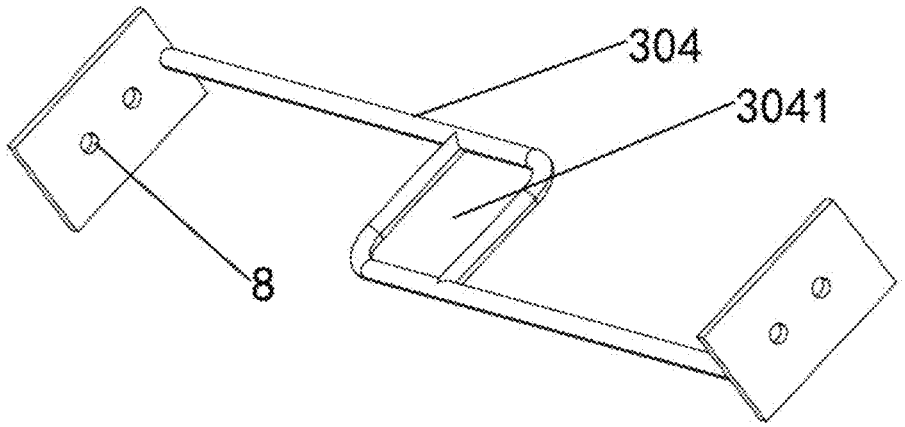
FIG. 11 is a schematic diagram of an overall structure of a reinforced connecting frame in FIG. 1.
Figure 12:
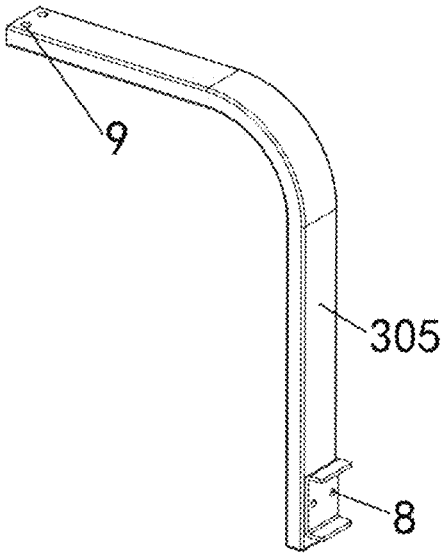
FIG. 12 is a schematic diagram of an overall structure of an L-shaped reinforcing rod in FIG. 1.
Figure 13:
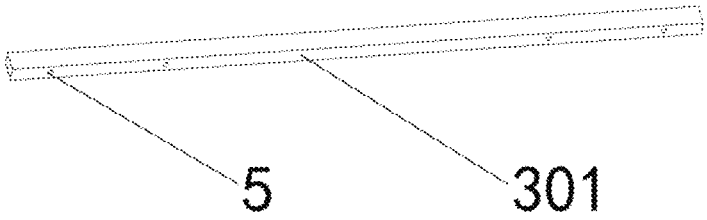
FIG. 13 is a schematic diagram of an overall structure of a reinforcing long rod in FIG. 2.

As shown in FIG. 1 to FIG. 12, the present embodiment provides an easy-to-transport three-spliced table, including table legs 2 arranged at four corners of a table top 1. The table legs 2 and the table top 1 are reinforced by a plurality of groups of reinforcing members 3; and the reinforcing member 3 includes a reinforcing long rod 301, a square reinforcing frame 302, a U-shaped reinforcing frame 303, a reinforced connecting frame 304, and an L-shaped reinforcing rod 305. The table top 1 is formed by splicing a first table plate 101, a second table plate 102 and a third table plate 103 side by side. The above components, after being assembled through bolts, are not different from a table with a complete table top, and are convenient to transport and dismount. During transportation, an assembled table with a table top capable of being spliced reduces the packaging volume, the transportation cost is saved, and the risk of packaging damage and product damage during transportation is reduced.

In this embodiment, frames 111 are both arranged around the first table plate 101, the second table plate 102 and the third table plate 103, two cross beams 112 are welded to an inner wall enclosed by the frames 111, the cross beams 112 are arranged in parallel, a lower surface of each of the cross beams 112 is coplanar with a lower surface of each of the frames 111, several vertical plates 113 are distributed on an upper surface of each of the cross beams 112, and two ends of each of the vertical plates 113 abut against the inner wall of the frames 111; and two side edges of the second table plate 102 are fixedly connected to a side edge of the first table plate 101 and a side edge of the third table plate 102 respectively through bolt holes A 4. Several bolt holes A are arranged on two splicing side edges of the frame in the second table plate respectively, several bolt holes A are arranged on a side edge, spliced with the second table plate, of the frame of the first table plate, and several bolt holes A are arranged on a side edge, spliced with the second table plate, of the frame of the third table plate. The first table plate and the second table plate, and the second table plate and the third table plate are respectively connected through the bolts and the bolt holes A. The first table plate, the second table plate and the third table plate are the same in size and similar in structure and are formed by combining a frame, a cross beam and a vertical plate. The first table plate, the second table plate and the third table plate are spliced side by side through the bolts to form a complete table top.

In this embodiment, a group of threaded holes B5 are arranged at the bottoms of the cross beams 112 of the first table plate 101 and the third table plate 103 respectively, and two groups of threaded holes B5 are arranged at the bottom of each of the cross beams 112 of the second table plate 102. Four transverse reinforcing long rods 301 are arranged at the bottom of the table top 1, a group of threaded holes B5 are arranged at two ends of each of the reinforcing long rods 301 respectively, and the reinforcing long rods 301 are arranged at the bottoms of two adjacent cross beams 112 of the first table plate 101 and the second table plate 102, the second table plate 102 and the third table plate 103 through the bolts and the threaded holes B5 for reinforcing the table top 1. The four reinforcing long rods are connected to two horizontally adjacent cross beams respectively, thereby improving the overall strength of the table top, and solving the problems of insufficient strength of a spliced table top and easy deformation after placing an item.

In this embodiment, connecting members 114 are fixed at four corners of the bottom of the table top 1, threaded holes C6 are arranged at a bottom surface of each of the connecting members 114 and a top surface of each of the table legs 2 respectively, and the top surface of each of the table legs 2 is connected to the bottom surface of each of the connecting members 114 through the bolts and the threaded holes C6. The table legs are connected and fixed at the four corners of the table top through the bolts.

In this embodiment, the table legs 2 are connected to a square reinforcing frame 302 through connecting rods 201; and one end of the connecting rod 201 is fixed in the middle of the table leg 2, threaded holes D7 are arranged on an end portion of the other end of the connecting rod 201 and four corners of the square reinforcing frame 302 respectively, and the end portion of the other end of the connecting rod 201 is connected to the four corners of the square reinforcing frame 302 through the bolts and the threaded holes D7. The square reinforcing frame is connected and fixed at the middle of the table leg through the bolts.

In this embodiment, the square reinforcing frame 302 is formed by splicing two U-shaped reinforcing frames 303; and a reinforced connecting frame 304 is mounted in an interior enclosed by the square reinforcing frame 302, L-shaped reinforcing rods 305 are mounted on two side edges of an outer portion of the square reinforcing frame 302 respectively, threaded holes E8 are arranged at two ends of the reinforced connecting frame 304, two side edges of the square reinforcing frame 302 and a side wall where a long edge of the L-shaped reinforcing rod 305 is located respectively, and the reinforced connecting frame 304, the square reinforcing frame 302, and the L-shaped reinforcing rod 305 are connected through the bolts and the threaded holes E8. The reinforced connecting frame is mounted in the middle of an inner enclosed area of the square reinforcing frame, the strength of the square reinforcing frame is improved through the reinforced connecting frame. Meanwhile, the reinforced connecting frame is used for fixing a sunshade umbrella handle, and the reinforced connecting frame is fixed to a connection of the two U-shaped reinforcing frames. L-shaped reinforcing rods are mounted on two side edges of an outer portion of the square reinforcing frame respectively, and the L-shaped reinforcing rods are fixed to the connection of the two U-shaped reinforcing frames. The connection of the U-shaped reinforcing frames and an end portion of the reinforced connecting frame coincide with a connection of the L-shaped reinforcing rods.

In this embodiment, threaded holes F9 are arranged at two side edges of a bottom surface of the table top 1 and an end portion where a short edge of the L-shaped reinforcing rod 305 is located respectively, and the bottom of the table top 1 is connected to the L-shaped reinforcing rod 305 through the bolts and the threaded holes F9. Two ends of the L-shaped reinforcing rod are connected to the table top and the square reinforcing frame through the bolts respectively, thereby improving the overall stability of the assembled table.

In this embodiment, a through hole is arranged in the middle of the second table plate 102 in a penetrating manner, an umbrella hole plug 10 is sleeved in the through hole, a reinforced connecting frame 304 is arranged right below the umbrella hole plug 10, and a placing hole 3041 is arranged in the middle of the reinforced connecting frame 304 in a penetrating manner and used for placing a sunshade umbrella handle. When a user uses the assembled table, the sunshade umbrella handle can penetrate through the umbrella hole plug and the placing hole, so that the sunshade stands upright in the middle of the assembled table for sun shading.

In the embodiment, an anti-skid gasket 202 is mounted at the bottom of the table leg 2, thereby improving the overall skid resistance of the assembled table.

Finally, it is noted that, the embodiments provided supra are only used to explain the technical solutions of the disclosure, not for limiting them. Although the disclosure has been illustrated in detail with reference to the above embodiments, a person of normal skill in the art should appreciate that, the technical solutions described in the above embodiments may be still modified, or, all or part of the technical features therein may be subjected to equivalent substitution, while such modifications or substitutions would not cause the essence of corresponding technical solutions to depart from the scope of respective technical solutions in the embodiments of the disclosure.

What is claimed is:

1. An easy-to-transport three-spliced table, comprising table legs (2) arranged at four corners of a table top (1), wherein the table legs (2) and the table top (1) are reinforced by a plurality of groups of reinforcing members (3); and the table top (1) is formed by splicing a first table plate (101), a second table plate (102) and a third table plate (103) side by side, wherein frames (111) are both arranged around the first table plate (101), the second table plate (102) and the third table plate (103), two cross beams (112) are welded to an inner wall enclosed by the frames (111), the cross beams (112) are arranged in parallel, a lower surface of each of the cross beams (112) is coplanar with a lower surface of each of the frames (111), several vertical plates (113) are distributed on an upper surface of each of the cross beams (112), and two ends of each of the vertical plates (113) abut against the inner wall of the frames (111); and two side edges of the second table plate (102) are fixedly connected to a side edge of the first table plate (101) and a side edge of the third table plate (103) respectively through bolt holes A (4).

2. The easy-to-transport three-spliced table according to claim 1, wherein a group of threaded holes B (5) are arranged at the bottoms of the cross beams (112) of the first table plate (101) and the third table plate (103) respectively, and two groups of threaded holes B (5) are arranged at the bottom of each of the cross beams (112) of the second table plate (102).

3. The easy-to-transport three-spliced table according to claim 1, wherein connecting members (114) are fixed at four corners of the bottom of the table top (1), threaded holes C (6) are arranged at a bottom surface of each of the connecting members (114) and a top surface of each of the table legs (2) respectively, and the top surface of each of the table legs (2) is connected to the bottom surface of each of the connecting members (114) through the bolts and the threaded holes C (6).

4. The easy-to-transport three-spliced table according to claim 1, wherein the table legs (2) are connected to a square reinforcing frame (302) through connecting rods (201); and one end of the connecting rod (201) is fixed in the middle of the table leg (2), threaded holes D (7) are arranged on an end portion of the other end of the connecting rod (201) and four corners of the square reinforcing frame (302) respectively, and the end portion of the other end of the connecting rod (201) is connected to the four corners of the square reinforcing frame (302) through the bolts and the threaded holes D (7).

5. The easy-to-transport three-spliced table according to claim 4, wherein the square reinforcing frame (302) is formed by splicing two U-shaped reinforcing frames (303); and a reinforced connecting frame (304) is mounted in an interior enclosed by the square reinforcing frame (302), L-shaped reinforcing rods (305) are mounted on two side edges of an outer portion of the square reinforcing frame (302) respectively, threaded holes E (8) are arranged at two ends of the reinforced connecting frame (304), two side edges of the square reinforcing frame (302) and a side wall where a long edge of the L-shaped reinforcing rod (305) is located respectively, and the reinforced connecting frame (304), the square reinforcing frame (302), and the L-shaped reinforcing rod (305) are connected through the bolts and the threaded holes E (8).

6. The easy-to-transport three-spliced table according to claim 5, wherein threaded holes F (9) are arranged at two side edges of a bottom surface of the table top (1) and an end portion where a short edge of the L-shaped reinforcing rod (305) is located respectively, and the bottom of the table top (1) is connected to the L-shaped reinforcing rod (305) through the bolts and the threaded holes F (9).

7. The easy-to-transport three-spliced table according to claim 1, wherein a through hole is arranged in the middle of the second table plate (102) in a penetrating manner, an umbrella hole plug (10) is sleeved in the through hole, a reinforced connecting frame (304) is arranged right below the umbrella hole plug (10), and a placing hole (3041) is arranged in the middle of the reinforced connecting frame (304) in a penetrating manner and used for placing a sunshade umbrella handle.

8. The easy-to-transport three-spliced table according to claim 1, wherein an anti-skid gasket (202) is mounted at the bottom of each of the table legs (2).

9. An easy-to-transport three-spliced table, comprising table legs (2) arranged at four corners of a table top (1), wherein the table legs (2) and the table top (1) are reinforced by a plurality of groups of reinforcing members (3); and the table top (1) is formed by splicing a first table plate (101), a second table plate (102) and a third table plate (103) side by side, wherein four transverse reinforcing long rods (301) are arranged at the bottom of the table top (1), a group of threaded holes B (5) are arranged at two ends of each of the reinforcing long rods (301) respectively, and the reinforcing long rods (301) are arranged at the bottoms of two adjacent cross beams (112) of the first table plate (101) and the second table plate (102), the second table plate (102) and the third table plate (103) through the bolts and the threaded holes B (5) for reinforcing the table top (1).

10. The easy-to-transport three-spliced table according to claim 9, wherein connecting members (114) are fixed at four corners of the bottom of the table top (1), threaded holes C (6) are arranged at a bottom surface of each of the connecting members (114) and a top surface of each of the table legs (2) respectively, and the top surface of each of the table legs (2) is connected to the bottom surface of each of the connecting members (114) through the bolts and the threaded holes C (6).

11. The easy-to-transport three-spliced table according to claim 9, wherein the table legs (2) are connected to a square reinforcing frame (302) through connecting rods (201); and one end of the connecting rod (201) is fixed in the middle of the table leg (2), threaded holes D (7) are arranged on an end portion of the other end of the connecting rod (201) and four corners of the square reinforcing frame (302) respectively, and the end portion of the other end of the connecting rod (201) is connected to the four corners of the square reinforcing frame (302) through the bolts and the threaded holes D (7).

12. The easy-to-transport three-spliced table according to claim 11 wherein the square reinforcing frame (302) is formed by splicing two U-shaped reinforcing frames (303); and a reinforced connecting frame (304) is mounted in an interior enclosed by the square reinforcing frame (302), L-shaped reinforcing rods (305) are mounted on two side edges of an outer portion of the square reinforcing frame (302) respectively, threaded holes E (8) are arranged at two ends of the reinforced connecting frame (304), two side edges of the square reinforcing frame (302) and a side wall where a long edge of the L-shaped reinforcing rod (305) is located respectively, and the reinforced connecting frame (304), the square reinforcing frame (302), and the L-shaped reinforcing rod (305) are connected through the bolts and the threaded holes E (8).

13. The easy-to-transport three-spliced table according to claim 12, wherein threaded holes F (9) are arranged at two side edges of a bottom surface of the table top (1) and an end portion where a short edge of the L-shaped reinforcing rod (305) is located respectively, and the bottom of the table top (1) is connected to the L-shaped reinforcing rod (305) through the bolts and the threaded holes F (9).

14. The easy-to-transport three-spliced table according to claim 9, wherein an anti-skid gasket (202) is mounted at the bottom of each of the table legs (2).

* * * * *